United States Patent [19]

Sakai

[11] Patent Number: 4,812,211

[45] Date of Patent: Mar. 14, 1989

[54] PROCESS AND SYSTEM FOR ELECTRODEPOSITION COATING

[76] Inventor: Hideyuki Sakai, 144, Okunagairi, Ohnishi-cho, Okazaki-shi, Aichi-ken, Japan

[21] Appl. No.: 164,417

[22] Filed: Mar. 4, 1988

[30] Foreign Application Priority Data

Oct. 31, 1987 [JP] Japan ..... 62-276216

[51] Int. Cl.[4] ..... C25D 9/00; C25D 13/00; C25D 17/06; C25D 17/26

[52] U.S. Cl. ..... 204/180.2; 204/181.1; 204/198; 204/214; 204/287; 204/300 EC; 204/297 R; 220/19; 118/58; 118/425

[58] Field of Search ..... 204/287, 214, 300 EC, 204/180.2, 180.1, 181.1, 198, 202–205, 259, 297 R; 220/19; 427/430.1; 118/425, 58

[56] References Cited

U.S. PATENT DOCUMENTS

| | | | |
|---|---|---|---|
| 3,382,844 | 5/1968 | Kumpf | 118/425 X |
| 3,429,797 | 2/1969 | Jackson et al. | 204/201 X |
| 3,607,712 | 9/1971 | Barton et al. | 204/202 |
| 3,674,673 | 7/1972 | Jessup | 204/214 X |
| 4,039,403 | 8/1977 | Astley et al. | 204/287 X |
| 4,059,493 | 11/1977 | Rice | 204/287 X |
| 4,162,951 | 7/1979 | Tscherwitschke | 204/214 X |
| 4,695,356 | 9/1987 | Poorten | 204/181.1 X |

FOREIGN PATENT DOCUMENTS

| | | |
|---|---|---|
| 57153328 | 2/1986 | Japan . |
| 57135641 | 2/1986 | Japan . |
| 60-61384 | 10/1986 | Japan . |
| 60192863 | 3/1987 | Japan . |

*Primary Examiner*—Donald R. Valentine
*Attorney, Agent, or Firm*—Fred Philpitt

[57] ABSTRACT

A relatively great number of materials such as forged or cast motor parts of relatively small sizes are loaded into a basket. The basket is suspended from a front conveyor, and is conveyed thereby to a position in front of a coating section comprising a plurality of tanks arranged in a required order and containing liquids required for the coating. After reaching the foregoing position, the basket is carried by, or suspended from, a basket carrier and is immersed in the liquids in the tanks in the order of arrangement thereof. The basket is swung in each tank several times. After being immersed in the liquids in all tanks, the basket is conveyed, by a rear conveyor, to a furnace for baking the materials coated. The basket is passed through the furnace, and then is suspended again from the front conveyor and conveyed thereby to a section where the basket is overturned to unload the materials coated and baked. Then, the basket, which is now empty, is conveyed to the initial position.

7 Claims, 7 Drawing Sheets

PROCESS AND SYSTEM FOR ELECTRODEPOSITION COATING

FIELD OF THE INVENTION

This invention relates to a basket for containing materials, such as forgings and castings, to be electrodeposition coated with paint and to a process and a system for electrodeposition coating such materials with paint. The basket, the process and the system of the invention are more particularly adapted for such materials of relatively small sizes and especially for forged parts, cast parts or the like of relatively small sizes for motorcars.

BACKGROUND OF THE INVENTION

One of the conventional processes for coating forged parts, cast parts or the like of motorcars with paint is illustrated in FIG. 17 of Japanese Published Unexamined Patent Application No. 61-220758. According to the process illustrated therein, a number of hangers each hanging a material to be coated with paint are suspended from a trolley conveyor, and spray guns provided on both sides of the conveyor spray a paint and other necessary liquids to the material while the material is being conveyed by the conveyor. Another conventional process is illustrated in FIG. 18 of the above-mentioned Japanese Application. According to the process illustrated therein, a number of hangers each hanging a material to be coated are also suspended from a trolley conveyor, but the material is dipped in a paint and other necessary liquids filled in storages while being conveyed by the conveyor.

However, either of the above-mentioned conventional processes is not free from the defect that the material may not be coated at its entire surface or may not be covered with a coating of a uniform thickness. Also, since only one material to be coated can be hung from each hanger, only a relatively small number of materials can be coated by one process. Moreover, since the material to be coated is hung from the hanger of a relatively small size, only materials with relatively limited weights can be coated. Furthermore, for either of the above-mentioned conventional processes, it may be necessary to use a device specially designed for holding the material to the hanger or to work out some other way of holding the material to the hanger. Also, since only one material can be hung from one hanger, either conventional process takes much time and trouble and, thus, has the defect that a great number of materials cannot be coated in a relatively short period of time.

The applicant has Japanese Pat. No. 1,339,372 and Japanese Utility Model Registration No. 1,650,688 which each disclose an electrodeposition-coating system where materials are electrodeposition coated and baked. Such a system may be effectively used to produce a coating of a uniform thickness on the entire surface of the material. The applicant also has Japanese Published Unexamined Patent Application No. 62-54097 which discloses a system similar to, but smaller than, those of the foregoing Japanese Patents. The system according to any one of these three prior arts comprises a number of hangers suspended from a conveyor for hanging a material to be electrodeposition coated, a plurality of tanks arranged in a required order and containing liquids required for electrodeposition coating the materials, and a furnace for baking the materials coated. In such a system, the materials hung from the hangers are immersed in the liquids in the tanks while being conveyed by the conveyor which is intermittently operated. However, the coating process by such a system is not free from the same defects as those of the foregoing two conventional coating processes. That is, since only one material is hung from each hanger, only a relatively small number of materials can be coated by one process. Also, since the material to be coated is hung from the hanger of a relatively small size, only materials with relatively limited weights can be coated. Moreover, it is necessary to use a device specially designed for holding the material to the hanger or to work out some other way of holding the material to the hanger. Also, since only one material can be hung from one hanger, such a process also takes much time and trouble and, thus, has the defect that a great number of materials cannot be coated in a relatively short period of time.

SUMMARY OF THE INVENTION

It is an object of the invention to provide a basket for containing a relatively great number of materials, such as forgings and castings, to be electrodeposition coated with paint.

Another object of the invention is to provide a basket for containing a relatively great number of such materials of relatively small sizes to be electrodeposition coated with paint.

A still another object of the invention is to provide a basket for containing a relatively great number of forged parts, cast parts or the like of relatively small sizes for motorcars which are to be electrodeposition coated with paint.

A further object of the invention is to provide a process and a system for electrodeposition coating materials such as forgings and castings, especially forged parts, cast parts or the like of relatively small sizes for motorcars with paint whereby a relatively great number of such materials can be coated, with no portions thereof left uncoated and to uniform thicknesses of coating, in a relatively short period of time.

A still further object of the invention is to provide such a process and a system whereby a relatively great number of materials to be electrodeposition coated are loaded into a basket and the basket containing the materials are immersed in liquids required for the coating thereof which are filled in tanks, and are swung therein to coat the materials at their entire surfaces, or with no portions thereof left uncoated, and to cover their entire surfaces with coatings of uniform thicknesses.

According to the invention, a basket is provided which has a sufficient size to contain a relatively large number of materials to be electrodeposition coated and which comprises (a) a body including a frame and a wire netting connected to the frame to form side walls and a bottom of said body, said body having an open top, (b) a pair of first horizontal arms projecting outward from two opposed ones of said side walls of the body, respectively, (c) a pair of vertical members projecting upward from the tops of said two opposed ones of said side walls, respectively, and (d) a pair of second horizontal arms projecting outward from said vertical members, respectively. However, if a relatively great number of materials are loaded into such a basket and the basket is merely immersed in liquids required for the coating thereof which are filled in tanks, the liquid in each tank may not reach every part of the surface of each material or some portions of the surface of each material may be covered with less amounts of liquid as compared with the other portions thereof, because some portoons of the materials in the basket may form a space or spaces into which no liquid can enter or some portions of the materials may be in closer contact with one another as compared with the other portions thereof. In such a case, some portions of the surfaces of the materials in the basket may not be coated at all or the surface of each material may not be covered with a coating of a uniform thickness. To remove such a defect, according to the invention, after being immersed in the liquid in each tank, the basket containing the materials is swung several times to allow the liquid in the tank to reach every part of the surface of each material or to uniformly cover the surface of each material.

According to the invention, baskets each containing a relatively great number of materials to be electrodeposition coated are suspended from a front conveyor, and are conveyed thereby to a position in front of a coating section comprising a plurality of tanks arranged in a required order and containing liquids required for the coating. After reaching the foregoing position, each basket is carried by, or suspended from, a basket carrier and is immersed in the liquids in the tanks in the order of arrangement thereof. Each basket is swung in each tank several times. After being immersed in the liquids in all tanks, each basket is conveyed, by a rear conveyor, to a furnace for baking the materials coated. The basket is passed through the furnace, and then is suspended again from the front conveyor and conveyed thereby to a section where the basket is overturned to unload the materials coated and baked. Then, the basket, which is now empty, is conveyed to the initial position.

DETAILED DESCRIPTION OF THE PREFERRED EMBODIMENT (1) Description of Basket

Figure 2:
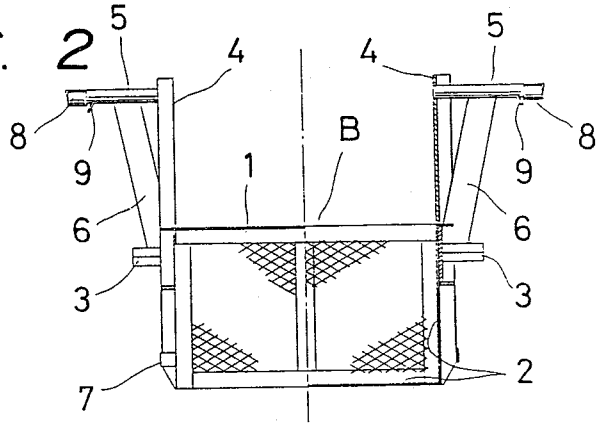
FIG. 2 is a front view of the basket of FIG. 1.
Figure 3:
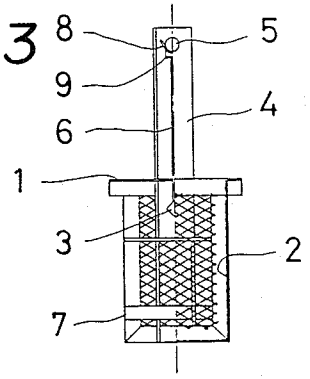
FIG. 3 is a side view of the basket of FIG. 1.
Figure 1:
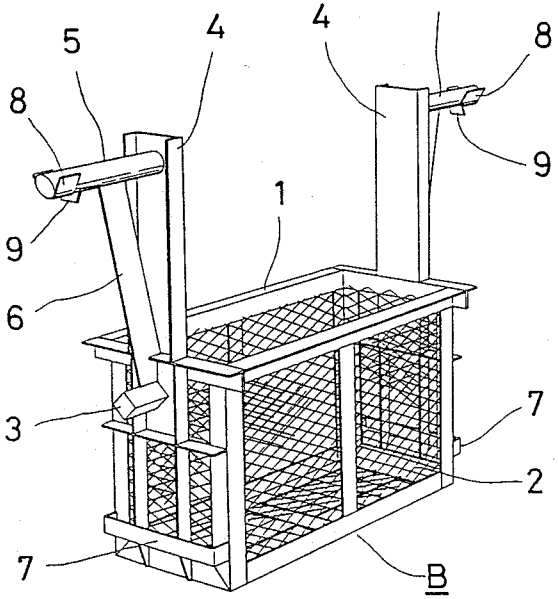
FIG. 1 is a perspective view of a basket according to the invention.

Referring to FIGS. 1 to 3, a basket B according to the invention into which materials such as forged or cast parts of relatively small sizes for motorcars are to be loaded for electrodeposition coating will now be described.

Figure 10:
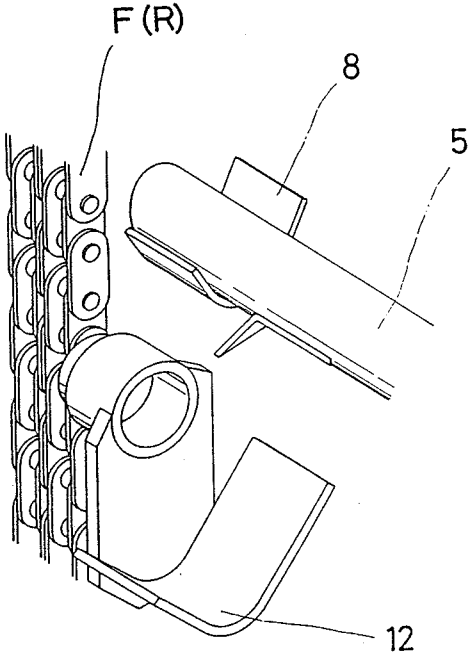
FIG. 10 shows one of basket supports connected to a rear or front conveyor used for the system of FIG. 4.

The basket B is shaped into a box with an open top. The basket B includes a frame 1 and a lattice 2 which is connected to both the inside of the frame 1 and the lower portion thereof. The lattice 2 consists of a number of wires of expanded metal each having a diamond-shaped cross section. The basket B also includes a pair of portions 4 projecting upward from the middles of the tops of two opposite sides of the basket, respectively. An outwardly-projecting horizontal rod 5 is connected to the upper portion of each upward projecting portion 4. A pair of outwardly-projecting short arms 3 are connected to the upper portions of the foregoing two opposite sides of the basket, respectively. Although each arm 3 has a diamond-shaped cross section in the illustrated embodiment, each arm may be shaped into a circular cross section. As clearly shown in FIG. 1, the horizontal rods 5 have greater lengths than the arms 3. Each rod 5 is connected, by a vertical flat member 6, to the arms 3 provided on the same side as the rod 5. The vertical member 6 serves to reinforce both the rod 5 and the arm 3. A guide member 7 projects outward from the lower portion of each of the opposite sides of the basket to which the arms 3 are connected. When the basket is conveyed by a conveyor 14 (which will be hereinafter described), the guide members 7 are guided by guide rollers provided in the conveyor 4 along two opposite sides thereof. A generally V-shaped member 8 is connected to the lower portion of the outward end portion of each rod 5, and is adapted to be supported on a basket support 12 which has a shape similar to that of the member 8 and which is swingably connected to either of a front conveyor F and a rear conveyor R (FIG. 10). Although only one support 12 is shown in FIG. 10, the same support as this is also swingably connected to a portion of the conveyor opposite to the portion thereof shown in FIG. 10. The basket B is raised or lowered, by the front or rear conveyor, with the members 8 of its opposed rods 5 being supported on the respective supports 12.

A piece 9 having a curved portion and a downwardly and outwardly projecting portion is connected, at its curved portion, to the lower portion of each rod 5, and is located slightly inwardly of the U-shaped member 8. The pieces 9 of the rods 5 are adapted to be supported on hooks 33 suspended from carrier beams 32 (which will be hereinafter described) and to be supported on support pieces 58 of a conveyor I (which will be hereinafter described).

(2) Description of Electrodeposition Coating System

Figure 4:
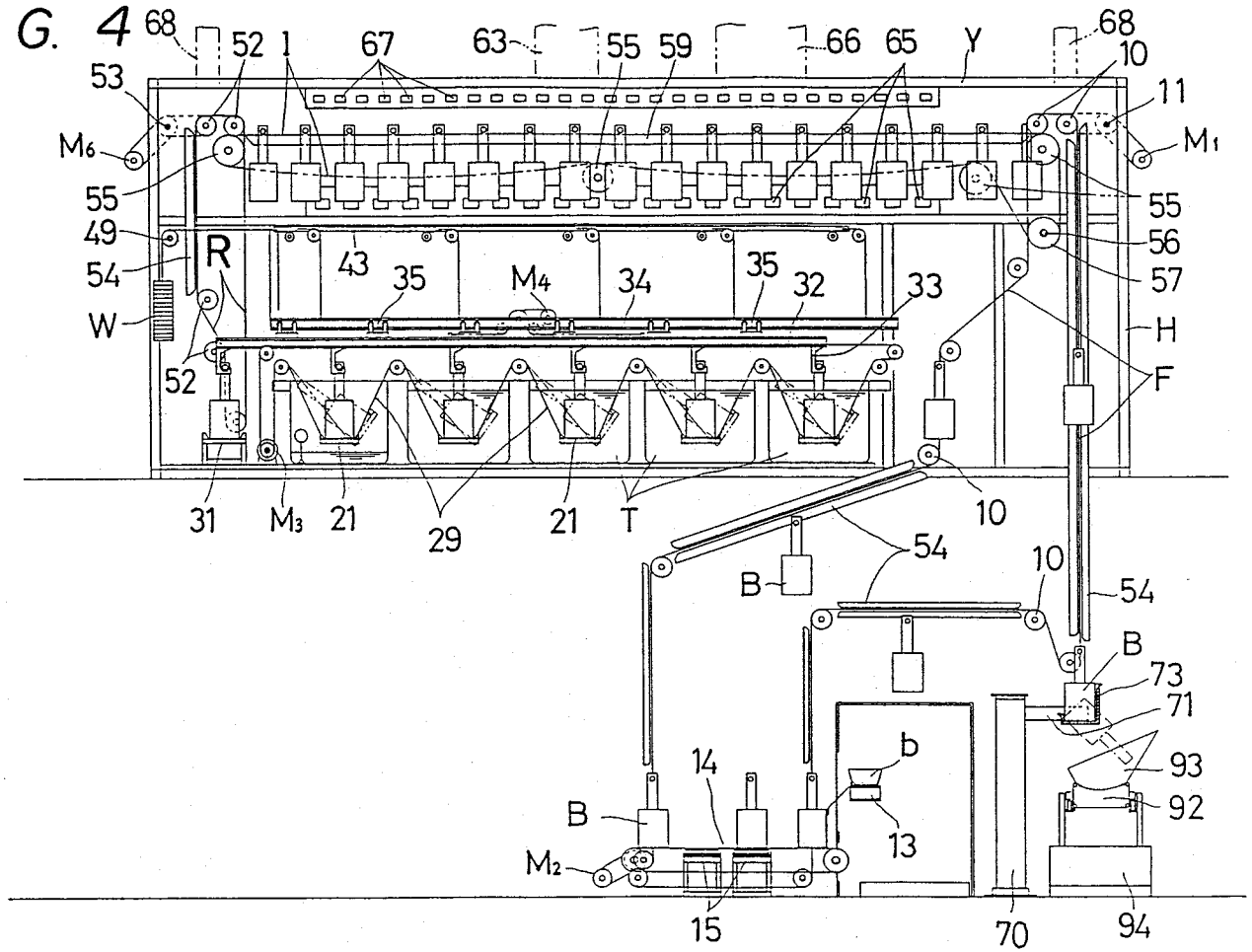
FIG. 4 is a front view of a system of the invention for electrodeposition coating materials such as forgings and castings with paint.

Referring chiefly to FIG. 4, an electrodeposition coating system according to the invention will now be described.

The system comprises a steel-frame building H with two stories. The building comprises steel pillars, steel beams and the like. On the first story are provided a device for loading materials (parts of motorcars) to be electrodeposition coated into a basket B, a device for unloading, from the baskets, the materials coated and baked, and the like. In the front section in the building H is provided a front chain conveyor F which extends through the front portion of the second story (or floor) to bridge the front spaces on the first and second stories. The front conveyor F includes a pair of opposed endless chain members each comprising a pair of chains connected to each other at opposed sides thereof (FIG. 10). The front conveyor lifts, from the first story to the second story, baskets B containing materials to be electrodeposition coated, and lowers, from the second story to the first story, baskets B containing the materials coated and baked. Also, in the rear section of the second story of the building H is provided a rear chain conveyor R which also includes a pair of endless chain member each comprising a pair of chains connected to each other at opposed sides thereof. The rear conveyor R lifts baskets B containing materials that have been electrodeposition coated.

The second story of the system is divided into upper and lower sections by a floor. A plurality of tanks T are provided on the lower section of the second story. The tanks are located between the front conveyor F and the rear conveyor R, as viewed from above. All the tanks T but one contain liquids, and materials in the baskets B are immersed in the liquids in the tanks. In the second story, directly above the tanks T are provided a vertically-movable basket carrier including a support member and a carrier member. In the upper section of the second story is provided a furnace Y for baking the materials in the baskets which have been immersed in the liquids in the tanks T. An endless chain conveyor I for passing the baskets B (containing the materials) through the furnace Y extends from one end of the furnace to an opposite end thereof. The conveyor I includes a pair of opposed endless chain members. The conveyor I will be hereinafter referred to as an "in-furnace conveyor".

Different mechanisms of the system of the invention will now be described.

(A) Description of Front Conveyor and Related Constructions

As described before, the front conveyor F includes a pair of opposed endless chain members. In FIG. 4, although only one of the two chain members is illustrated, the other chain member is disposed just at the back of the illustrated chain member. Also, FIG. 10 shows a portion of one of the two chain members of the conveyor F (or R). The conveyor F is intermittently operated in a clockwise direction by a geared motor $M_1$ (FIGS. 4 and 5) connected to the outside of a portion of the wall of the building H which is in proximity to the top portion of the conveyor F. As described before, the conveyor F includes a pair of opposed chain members. The chain members are fitted on sprockets 10 which are provided in pairs. A drive shaft 11 is operatively connected to both the motor $M_1$ and the uppermost and rightmost pair of sprockets 10 (FIG. 4).

When the geared motor $M_1$ is operated, the uppermost and rightmost pair of sprockets 10 are rotated through a chain or gear, so that the chain members are synchronously operated in a clockwise direction.

A plurality of basket supports 12 are swingably connected to the inside of each of the two opposite chain members of the conveyor F. FIG. 10 shows only one support 12. The supports of each chain member are spaced apart from one another at certain intervals. Each support 12 of each chain member is opposed to one of the supports 12 of the other chain member. A basket B is raised or lowered, by the conveyor F, with the curved members 8 of its opposite rods 5 being supported on the opposed supports 12 of the two chain members of the conveyor F.

Numeral 13 designates a device for loading materials to be electrodeposition coated, into an empty basket B removed from the conveyor F onto the foremost portion of a chain conveyor 14. This device includes a bucket b. This device loads materials to be coated, into the basket B in one of two ways. One way is to load the materials into the bucket b and convey the bucket to a predetermined position and load the materials from the bucket into the basket. The other way is not to use the bucket, but to align a number of materials to be coated, in front of the conveyor 14 and load one or more of the materials, in the predetermined number, into the basket. The materials to be coated in the system are shot-peened, or degreased, in advance, before being loaded into the basket. The basket, removed from the conveyor F onto the conveyor 14 and loaded with the materials, is moved to the extreme left position (in FIG. 4) by the conveyor 14, and then suspended from the conveyor F by a pair of opposed basket supports 12 of the conveyor F supporting the outer ends (the curved portions 8) of the two horizontal rods 5 of the basket FIG. 10). The conveyor 14 is intermittently operated by a geared motor $M_2$ disposed in proximity to the rearmost portion of the conveyor 14. A pair of roller conveyors 15 are provided on the left side of the chain conveyor 14 as viewed from the side of the front portion of the conveyor 14. The roller conveyors 15 are perpendicular to the conveyor 14. A basket B not removed from the conveyor F onto the conveyor 14, but separately prepared with materials (to be coated) therein, may be placed on either roller conveyor 15 and conveyed onto the conveyor 14 by the conveyor 15.

(B) Description of Tanks

Figure 6:
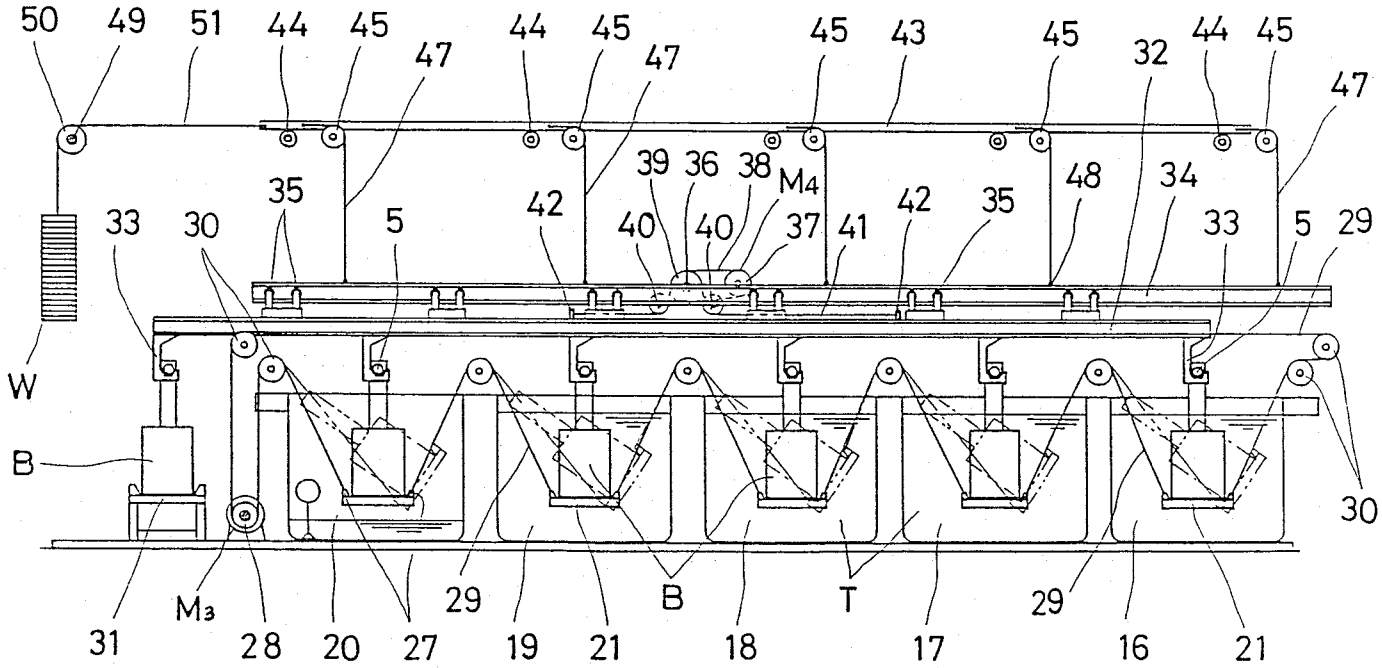
FIG. 6 shows a plurality of tanks and a basket carrier used for the system of FIG. 4.

Referring to FIG. 6, the tanks T are five in number. Namely, tanks 16, 17, 18, 19 and 20 are provided in the order mentioned. The first tank 16 is filled with pure water. The materials in the basket B are rinsed by being immersed in the pure water in the tank 16. In other words, the materials in the basket are pretreated in the tank 16 for electrodeposition coating thereof in the next tank 17. The second tank 17 is filled with a coating paint. The basket is removed from the tank 16 into the second tank 17, and the materials therein are electrodeposition coated with the paint. The third tank 18 is filled with water. The basket is removed from the second tank 17 into the third tank 18, and the materials are rinsed therein. In other words, the materials are post-treated in the third tank 18. The fourth tank 19 is also filled with water. The basket is removed from the third tank 18 into the fourth tank 19, and the material is rinsed therein. In other words, the materials are subjected to an additional post-treatment in the fourth tank 19. The fifth tank 20 is not filled with any liquid. The basket is removed from the fourth tank 19 into the fifth tank 20, and drops of the liquid on the materials are allowed to fall therein.

Figure 7:
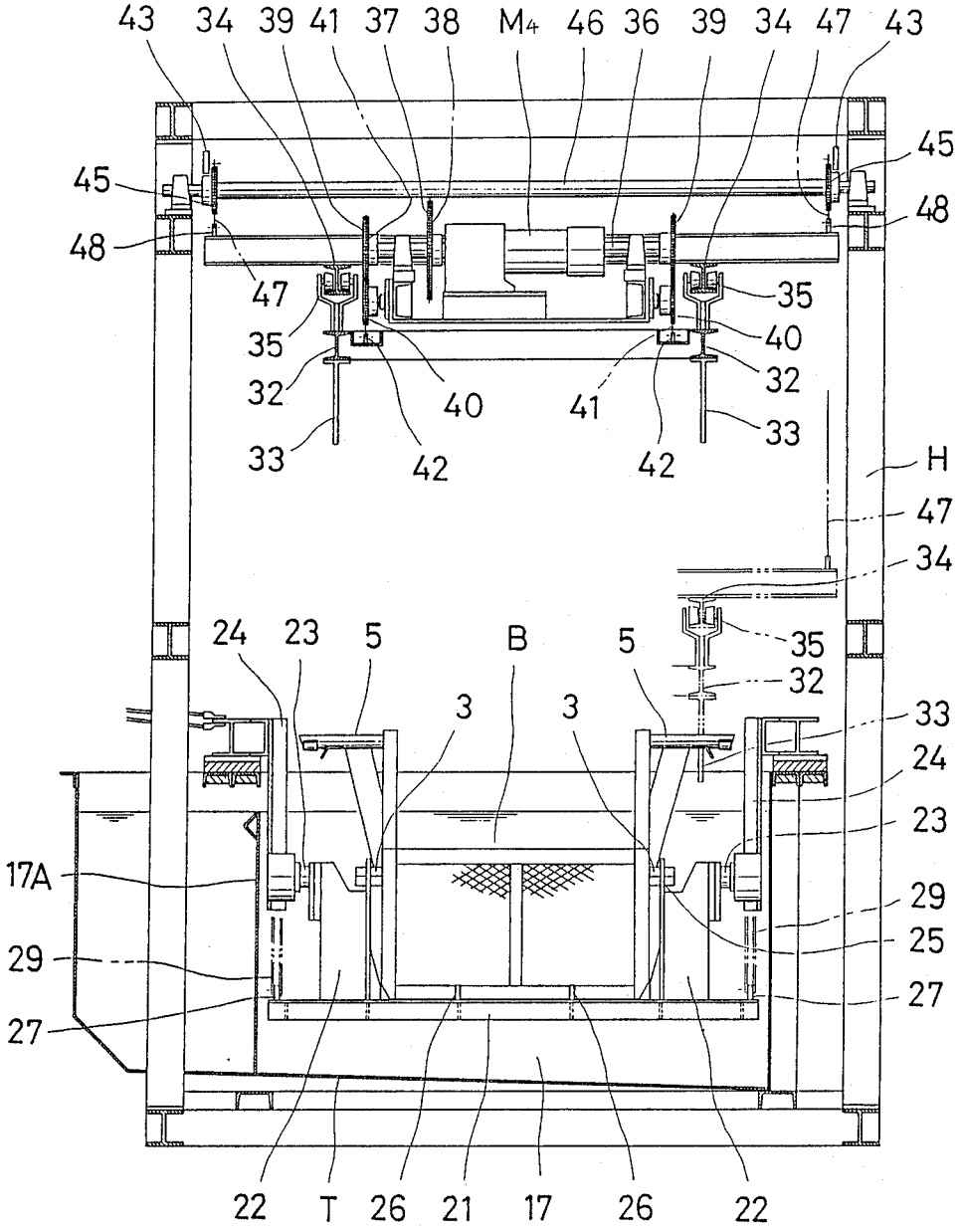
FIG. 7 is a vertical cross section of one of the tanks of FIG. 6.

The second, third and fourth tanks 17, 18 and 19 each include a primary chamber and a secondary chamber which are separated from each other by a partition 17A, as shown in FIG. 7. For each of the three tanks, the foregoing liquid (paint or water) is filled into the primary chamber, and the basket is immersed therein. The partition 17A has a smaller height than the entire tank and, hence, the liquid filled into the primary chamber is allowed to overflow into the secondary tank. The portion of the liquid that has overflowed into the secondary tank is passed, for reuse, through a circulating pump and a filter.

The illustrated system according to one preferred embodiment of the invention is adapted for electrodeposition coating materials which have been shot-peened, or degreased, in advance. The system, however, may be modified to coat materials which have not been shot-peened in advance. For such materials, a material-treating process used for an electrodeposition coating system disclosed in Japanese Published Examined Patent Application No. 61-4920, Japanese Published Examined Utility Model Application No. 61-4530 or Japanese Published Unexamined Patent Application No. 62-54097 may be utilized. That is, the following group of tanks may be provided, in the order mentioned below, to pretreat materials before treating and coating the materials in the tanks 16 to 20:

(a) a tank wherein the materials are degreased, in advance, by water discharged from a nozzle or a shower.
(b) a tank wherein the materials are alkaline degreased.
(c) a tank wherein the materials are rinsed.
(d) a tank wherein the materials are prepared in their surfaces.
(e) a tank wherein the materials are treated with phosphoric acid and zinc to form a film or coating thereon.
(f) a tank wherein the materials are rinsed again.

(C) Description of Mechanism for Swinging Basket

Figure 8:
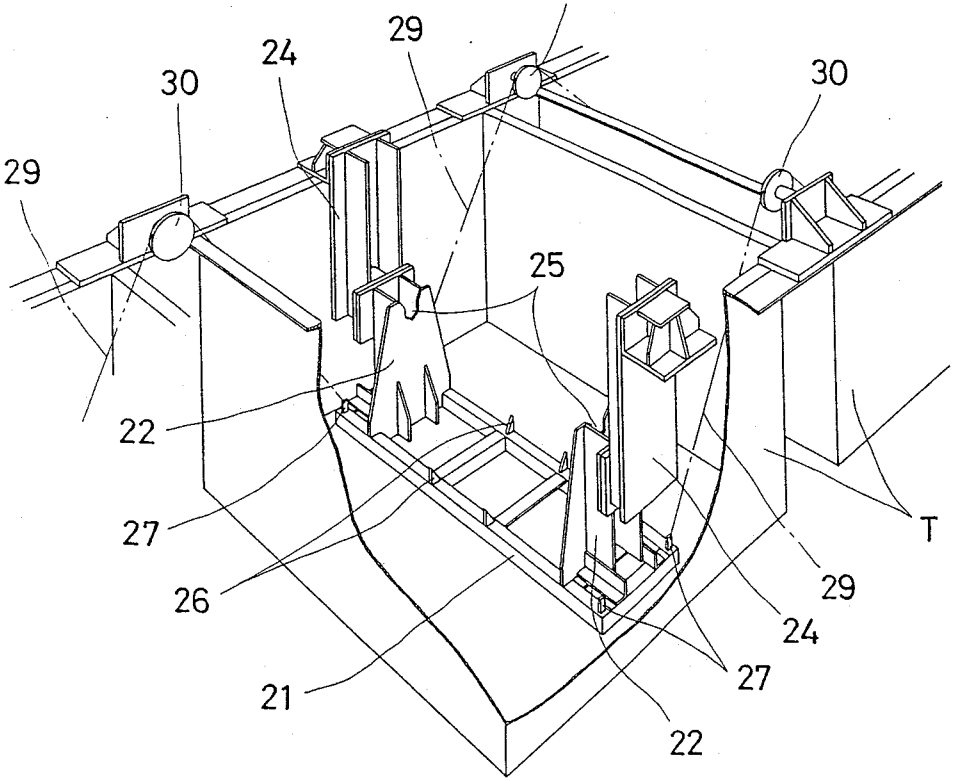
FIG. 8 shows a basket-swinging mechanism provided in each tank of FIG. 6.
Figure 11:
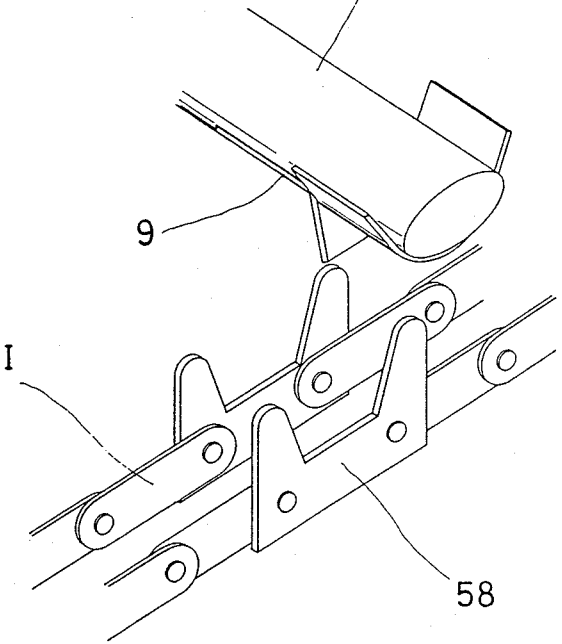
FIG. 11 shows one of basket supports provided in a conveyor located in a baking furnace used for the system of FIG. 4.

Referring to FIGS. 6, 7 and 8, a mechanism for swinging a basket is provided in each tank. This mechanism comprises a base 21 and a pair of opposed frames 22. The base 21 is shaped into a ladder as viewed from above. The base 21 has one end in close proximity to one side of the tank and has an opposed end in close proximity to the other side thereof. The base 21 is positioned above the bottom of the tank. The frames 22 extend upwardly from opposed end portions of the base 21, respectively. Each frame 22 has a recess 25 in its uppe portion. In each tank, a basket B is placed on the base 21 so that the opposed arms 3 of the basket rest in the recesses 25 of the frame 22. Each frame 22 is connected to a pivot 23. Each pivot 23 projects from a lower end portion of a support frame 24 which has an upper end portion connected to the middle of the top of one side of the tank and a portion extending downwardly, inside the tank, along the foregoing side of the tank. From the central portion of the base 21 project four pieces 26 to prevent the basket from removing from the base 21 when the basket is being swung Four fittings 27 are provided on the respective four corners of the base 21. The opposed fittings 27 on each end portion of the base 21 are connected, by opposed chains 29, to the adjacent fittings 27 of the base 21 of the respective swinging mechanisms in the adjacent tanks. The opposed chains 29 are fitted on a pair of opposed sprockets 30 provided between the adjacent tanks. Thus, all swinging mechanisms in the different tanks are connected to one another by the chains 29. And the first tank 21 is connected to the fifth tank 20 by chains 29 which are connected to the front fittings 27 of the base 21 of the swinging mechanism in the first tank 21, fitted on sprockets 30 provided in front of the first tank 21 and in a position higher than the top of the tank 16, guided by opposed carrier beams 32, fitted on sprockets 30 provided at the back of the fifth tank 20 and in a position higher than the top of the tank 20, fitted on sprockets 28, fitted on sprockets 30, and connected to the rear fittings 27 of the base 21 of the swinging mechanism in the fifth tank 20. The sprockets 28 are connected to and operated by a drive shaft of a geared motor $M_3$, and thus are adapted to operate the chains 29. The geared motor $M_3$ is adapted to rotate in either direction. It will be appreciated that, when the motor $M_3$ is operated, the swinging mechanisms in all the tanks are swung, on the pivots 23, to swing the baskets B supported in the swinging mechanisms. When the materials in the baskets in the respective tanks are treated or coated as mentioned before, the baskets are swung in this manner. A table 31 is provided at the back of the geared motor $M_3$. The basket with the materials therein, after being removed from the last tank 21, is placed on the table 31. The table 31 has a basket support surface, or upper surface, which is substantially at the same level as the upper surface of the base 21 of the swinging mechanism in each tank.

(D) Description of Basket Carrier

Referring to FIGS. 4, 6 and 7, a basket carrier will now be described. The basket carrier is located directly above the tanks, and includes an upper horizontal member, or support member, and a lower horizontal member, or carrier member. The support member comprises a pair of horizontal parallel I-beams 34 connected to each other by a plurality of transverse elements. Also, the carrier member comprises a pair of horizontal parallel I-beams 32 connected to each other by a plurality of transverse elements. The transverse elements of the support member are arranged at equal intervals and connected to the upper surfaces of the I-beams 34 thereof, and have lengths much greater than the distance between the two I-beams 34. The transverse elements of the carrier member are also arranged at equal intervals, but are connected to the insides of the I-beams 32 thereof, and thus the whole of the carrier member is shaped into a ladder as viewed from above. The I-beams 34 of the support member will be hereinafter referred to as "lift beams". Also, the I-beams 32 of the carrier member will be hereinafter referred to as "carrier beams". A plurality of generally L-shaped hooks 33 are suspended from each carrier beam 32. The hooks 33 are arranged along the length of the beam 32 at equal intervals. Each hook 33 is adapted to support one of the rods 5 of a basket B at the curved portion of the piece 9 of the rod 5, and thus is adapted to support the entire basket together with the opposed hook 33 of the opposed carrier beam 32. Each beam 32 is connected to the lift beam 34 located above the beam 32, by a plurality of members fixed to the upper surface of the beam 32 at equal intervals and having generally Y-shaped cross sections. Each Y-shaped member has a pair of rollers 35 in one of the opposed cavities of the lift beam 34, and also has a pair of rollers 35 in the other cavity of the beam 34. Each roller 35 is in contact with the bottom of the beam 34, and is adapted to roll thereon along the length of the beam 34. Thus, the carrier beams 32 are allowed to move relative to the lift beams 34 in horizontal directions and, hence, the entire carrier member is movable relative to the support member.

Description of Carrier Member

Referring to FIGS. 6 and 7, a geared motor $M_4$ is disposed in a support frame provided between the lift beams 34. The geared motor $M_4$ can be rotated in either direction, and has its object in moving the carrier member, by a given distance, relative to the support member in a forward or backward direction. Numeral 36 designates a rotatable shaft for moving the carrier beam 32. The shaft 36 is supported, at its both ends, by the foregoing support frame. Also, the shaft 36 is rotated by a drive chain 38 which is fitted on a drive sprocket 37 fixed to an output shaft of the geared motor $M_4$ and on a driven sprocket fixed to the drive shaft 36. A pair of opposed drive sprockets 39 are fixed to the end portions of the drive shaft 36, respectively. The foregoing driven sprocket fixed to the drive shaft 36 is coaxial with the sprockets 39. A pair of spaced-apart guide sprockets 40 are rotatably connected to one side of the support frame in conjunction with one of the drive sprockets 39. Also, a pair of spaced-apart guide sprockets 40 are rotatably connected to an opposed side of the support frame in conjunction with the other drive sprocket 39. Two of the transverse elements of the carrier element each have opposed recesses in their opposed end portions, and a fitting 42 is provided in each recess. A chain 41 is fitted on the associated drive sprocket 39 and guide sprockets 40, and is connected, at one end thereof, to the fitting 42 in one of the recesses of one of the two transverse elements of the carrier element and also connected, at the other end thereof, to the fitting 42 in one of the recesses of the other of the two transverse elements of the carrier element. Thus, the chains 41 serve to move the carrier member (relative to the support member).

Description of Support Member

Referring to FIGS. 6 and 7, a pair of opposed parallel horizontal bars 43 extend above the support member. The bars 43 are parallel to the support member. One of the bars 43 extends above and along one side of the support member, and the other bar 43 extends above and along the opposed side of thereof. Each bar 43 is movably supported on a plurality of guide rollers 44 which are provided along the length of the bar at equal intervals. A guide sprocket 45 is provided in conjunction with each guide roller 44. Each pair of opposed guide sprockets 45 are fixed to opposed end portions of a transverse rotatable drive shaft 46, respectively. A fitting 48 is connected to each of opposed end portions of each transverse element of the support member. Each fitting 48 is located directly below one of the guide sprockets 45. A chain 47 is connected, at one end thereof, to each fitting 48, and is fitted on the associated guide sprocket 45 and connected to the bar 43. Thus, the support member and the opposed bars 43 are connected to each other by the chains 47. A transverse drive shaft 49 extends horizontally in the uppermost portion of the rearmost portion of the lower section of the second story. A pair of sprockets 50 are fixed to the opposed end portions of the shaft 49, respectively. A chain 51 is fitted on each sprocket 50. Each chain 51 is connected, at one end thereof, to the rear end of one of the two bars 43. A single balance weight W is suspended from the other ends of the two chains 51. The balance weight W comprises a number of plates laid on one another. A geared motor $M_5$ is fixed to a portion of the outside of the rear wall of the building H which is in close proximity to the drive shaft 49. The geared motor $M_5$ is rotatable in either direction, and is connected to the shaft 49. Thus, when the motor $M_5$ is operated, the chains 51 and, hence, the two bars 43 are simultaneously moved in a forward or backward direction to move upwardly or downwardly the support member and, hence, the entire basket carrier.

(E) Description of Rear Conveyor

Figure 5:
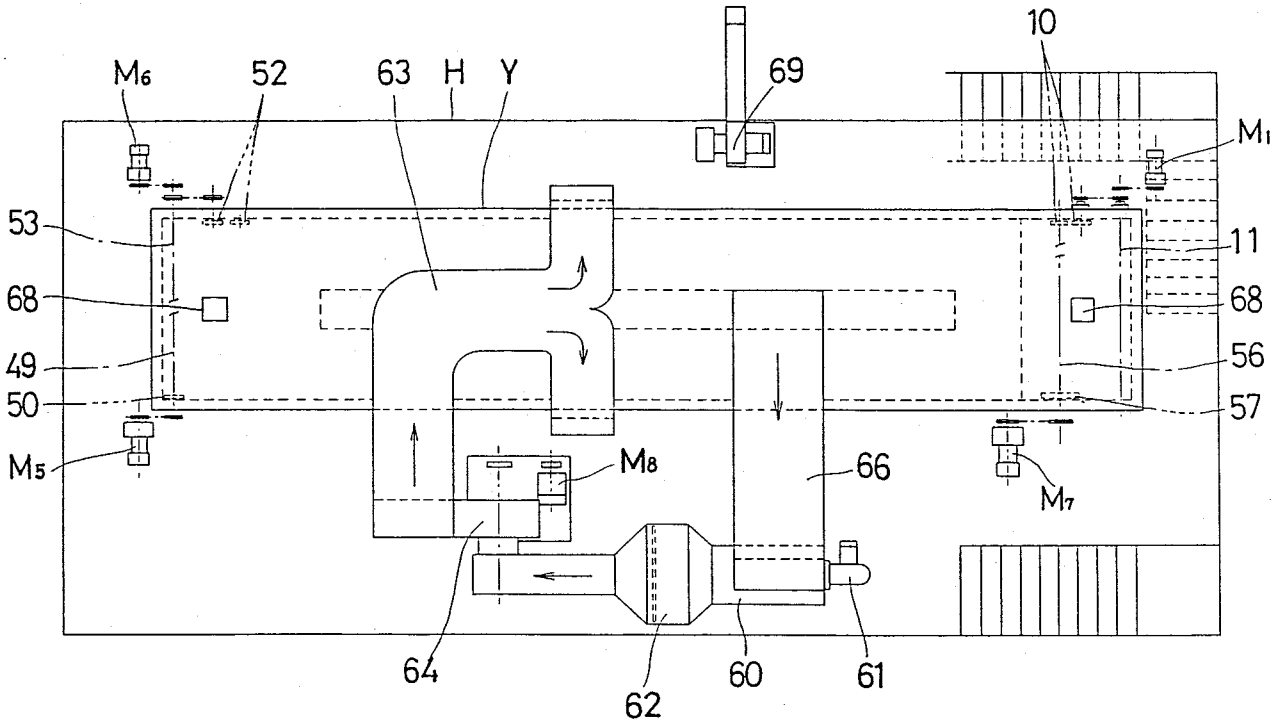
FIG. 5 is a plan view of the system of FIG. 4.

Referring to FIGS. 4 and 5, a geared motor $M_6$ for intermittently operating the rear conveyor R is connected to the upper portion of the outside of the rear wall of the building H. The endless rear conveyor R is fitted on sprockets 52. A horizontal rotatable shaft 53 is provided in the upper portion of the rear portion in the second story of the building H. The shaft 53 is not only connected to the geared motor $M_6$ by a chain, but also connected to the uppermost and leftmost pair of sprockets 52 by chains, and conveys the motion (rotation) of the motor $M_6$ to the two sprockets 52 through the chains in such a manner that the opposed chain members of the conveyor R are simultaneously operated in a clockwise direction. Gears, instead of the chains, may be employed as means for conveying the motion of the motor $M_6$. As in the case of the opposed chain members of the front conveyor F, the opposed chain members of the rear conveyor R are provided with a plurality of swingable basket supports 12 at the insides thereof. After being coated and treated in the tanks, a baskets B are lifted into the furnace Y, by the conveyor R, with the outer end portions (V-shaped portions 8) of its opposed rods 5 being supported on the opposed supports 12 of the conveyor R.

Numeral 54 designates a plurality of conveyor guides provided along different portions of the two conveyors F and R.

(F) Description of In-furnace Conveyor

A geared motor $M_7$ for intermittently operating the infurnace conveyor I is fixed to the front section of the wall of the building H (FIG. 5). As previously mentioned, the infurnace conveyor I comprises a pair of opposed endless chain members. The two chain members are fitted on a plurality of sprockets 55. A transverse drive shaft 56 is provided in the front section of the second story of the building H. The shaft 56 is connected to the geared motor $M_7$ by a chain. A pair of sprockets 57 are fixed to opposed end portions of the drive shaft 56, respectively. The opposed endless chain members are fitted on the respective sprockets 57, as well as on the other sprockets 55. When the motor $M_7$ is operated, the opposed chain members are moved in a clockwise direction. Each chain member is provided with a plurality of support pieces 58. Each support piece 58 of each chain member is opposed to one of the support pieces of the other chain member. Baskets B are conveyed by the conveyor I with the outer end portions, or pieces 9, of the opposed rods 5 of the baskets B being supported on the support pieces 58. Numeral 59 designates a guide for the two chain members of the conveyor I.

(G) Description of Baking Apparatus

Referring to FIG. 5, a baking apparatus is provided on the floor separating the upper and lower sections of the second story from each other. The baking apparatus comprises the following:

a. a combustion furnace 60.
a. a burner 61.
b. a filter box 62.
c. a duct 63 for introducing hot air produced in the furnace 60 into the furnace Y.
d. a duct 66 for introducing hot air discharged from exhaust openings 67 of the baking furnace Y into the combustion furnace 60.
e. a pair of upright ducts 68 projecting from the front and rear portions of the top of the building H, respectively.

f. a device for exhausting the air from the tank 17, which includes an exhaust fan and an exhaust duct.

The duct 63 has a hot air circulating fan 64. Opposite sides of the wall of the furnace Y are each provided with a plurality of openings 65 (FIG. 4). Hot air is blasted through the duct 63 by the fan 64, and enters the furnace Y through the openings 65 of the opposed sides thereof. The air discharged from the exhaust openings 67 and introduced into the furnace 60 is heated for reuse.

(H) Description of Mechanism for Overturning Basket

Figure 9:
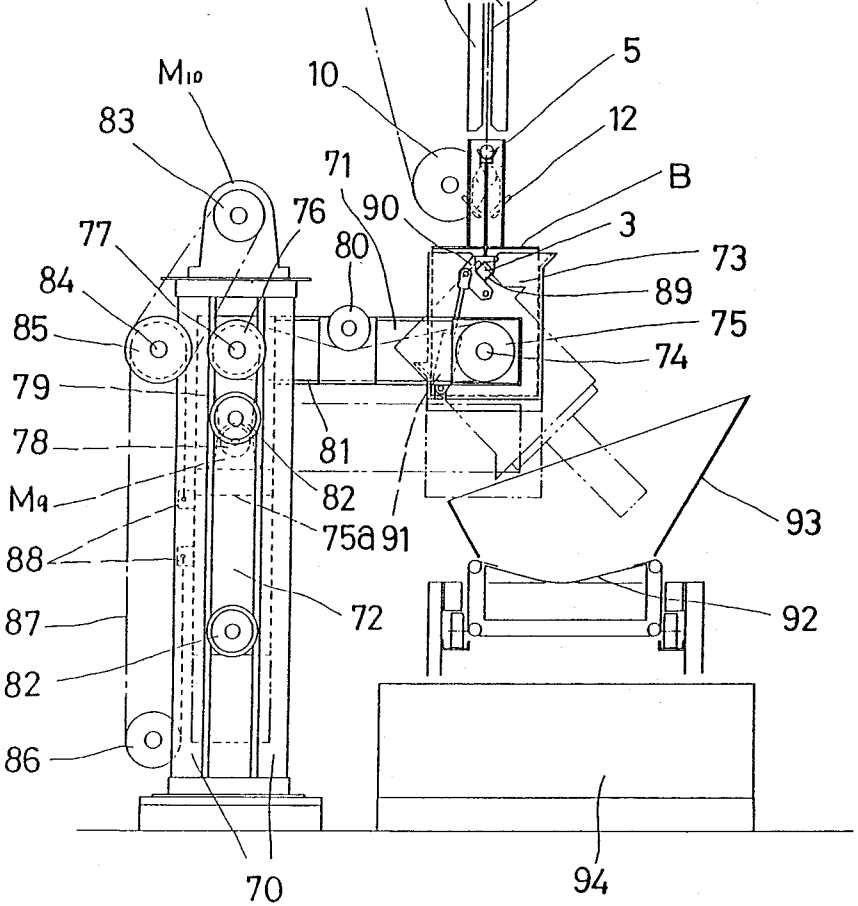
FIG. 9 shows a mechanism for overturning the basket of FIG. 1.

On the front section of the first story is provided a mechanism for overturning a basket B to unload products, or materials electrodeposition coated and baked, from the basket B. This mechanism is illustrated in FIG. 4 and particularly in FIG. 9. This mechanism includes a pair of opposed posts 70. Although only one of the posts 70 is shown in FIG. 9, the other one is disposed right behind the illustrated one. Each post 70 includes a pair of vertical members (FIG. 9). A vertical frame 72 is supported, for vertical movement, by each post 70. At the outside of each post 70, a horizontal arm 71 is connected to the top of the each frame 72 at a right angle to the frame. A case 73 is connected to the forward end portons of the two arms 71 by a pair of short rotatable pins 73, and is located between the two arms. The case 73 is opened at both the top and the rear side thereof. One of the pins 74 extend through the forward end portion of one of the arms 71 and one side of the case 73, and the other pin 74 extends through the forward end portion of the other arm and the opposed side of the case 73, respectively. A sprocket 75 is fixed to each pin 74. The frames 72 connected to the opposed posts 70 are connected to each other by a horizontal support member 75*a*. Between the two posts 70, a geared motor $M_9$ is supported on the support member 75*a*. A drive sprocket 78 is connected to each end of an output shaft of the motor $M_9$. Above each sprocket 78 is disposed a sprocket 76. Each sprocket 76 is connected to one end of a horizontal drive shaft 77 which is rotatably provided between the two posts. The associated lower and upper sprockets 78 and 76 are connected by a drive chain 79 which is fitted on the two sprockets 78 and 76. A tension sprocket 80 is provided in each arm 71. The associated sprockets 76, 80 and 75 are connected to one another by a chain 81 which are fitted on the sprockets 76, 80 and 75. The motor $M_9$ is rotatable in either direction. A basket B conveyed or lowered by the front conveyor F, with materials electrodeposition coated and baked therein, is unloaded or placed from the conveyor F into the case 73. When the motor $M_9$ is rotated in one direction, the case 73 is overturned from its upright position to overturn the basket B, thereby unloading the materials therein into a chute 93 which will be hereinafter described. When the motor $M_9$ is rotated in the other direction, the case 73 and, hence, the basket B are returned to its upright position from the overturned position.

In each post, the frame 72 is provided with a pair of upper and lower guide rollers 82. The guide rollers 82 are disposed between the opposed vertical members of the post, and are in contact with the opposed inner surfaces of the vertical members. When the frame 72 is vertically moved, the rollers 82 roll on the foregoing inner surfaces to move vertically. A geared motor $M_{10}$ is connected to the top of one of the posts 70. This motor $M_{10}$ is rotatable in either direction. A drive sprocket 83 is connected to each end of an output shaft of the motor $M_{10}$. A horizontal rotatable shaft 84 extends from a position in close proximity to the upper end portion of one of the posts 70 to a position in close proximity to that of the other post. A sprocket 85 is connected to each end of the shaft 84. The associated sprockets 83 and 85 are connected by a chain which is fitted on the sprockets 83 and 85. In conjunction with each sprocket 85, a sprocket 86 is provided at the lower end portion of each post. The sprockets 85 and 86 are connected to each other by a chain 87 which is fitted on the sprockets 85 and 86. The chain 87 is fixed to the frame 72 at 88. When the motor $M_{10}$ is rotated, the frame 72 is vertically moved.

The tops of two opposed side walls of the case 73 are recessed at opposed, central portions 89 thereof. A basket B is unloaded or placed from the front conveyor F into the case 73 in such a manner that the opposed arms 3 of the basket B are received in the recesses 89. Directly below each recess 89, a hook 90 is pivotally connected to the outside of each of the foregoing side walls of the case 73. A piston-type cylinder 91 is pivotally connected, at an upper end thereof, to each hook 90, and is also pivotally connected, at a lower end thereof, to the lower end portion of the outside of the side wall to which the hook 90 is connected. When a basket B is placed in the case 73 with its opposed arms 3 coming into the recesses 89 thereof, the cylinders 91 are operated to cause the hooks 90 to firmly hold the arms 3 into the recesses. Thus, when the basket is overturned, the hooks 90 prevent the basket from dropping from the case 73.

A belt conveyor 92 is disposed below the case 73. A chute 93 is supported on a frame of the conveyor 92. The chute 93 is located in such a position that, when the case 73 in which the basket B is placed is overturned, the materials coated, or products, in the basket are dropped into the chute 93. Also, the chute 93 is opened at its bottom, and the products dropped from the basket thereinto are allowed to fall directly on the conveyor 92. And the products are conveyed by the conveyor 92. A pallet 94 for storing the products is provided at one end of the conveyor 92.

(3) Description of Process for Electrodeposition Coating Materials

Figure 12:
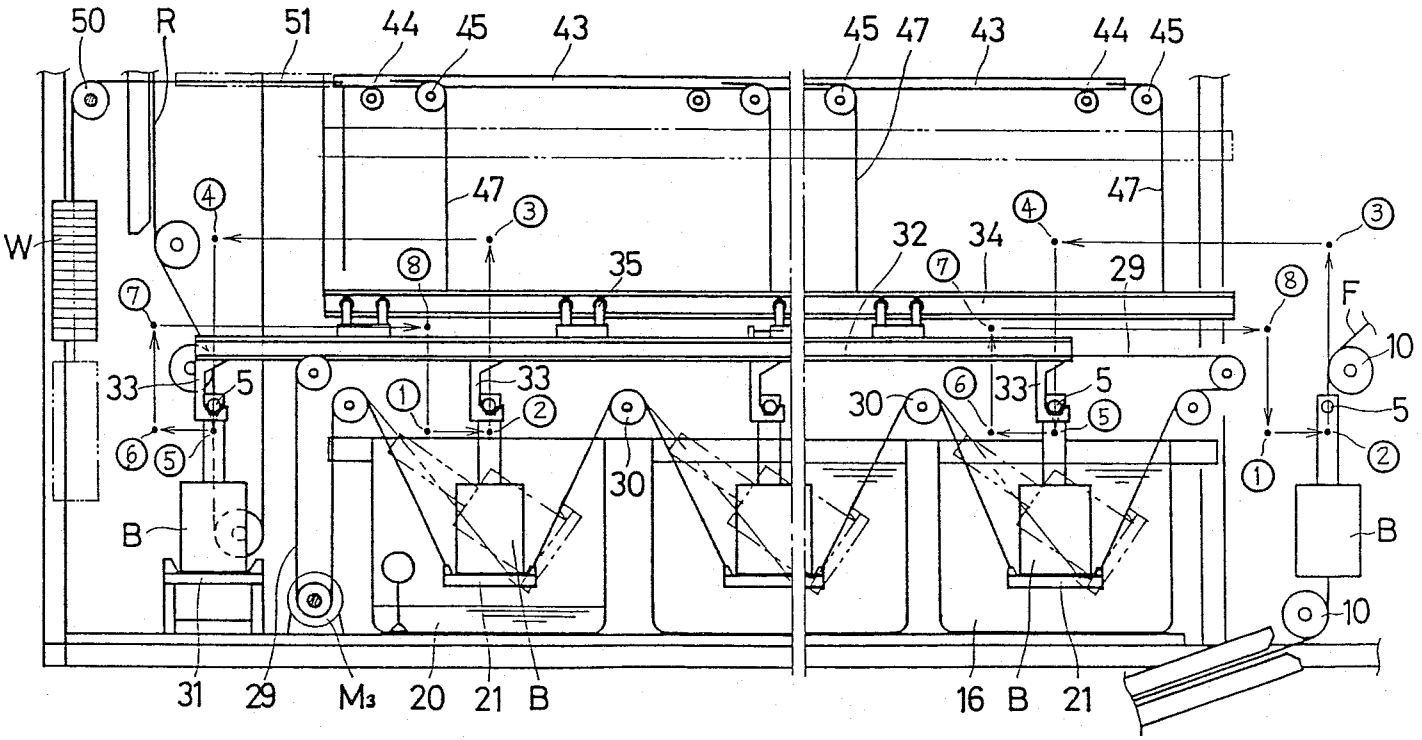
FIG. 12 shows how the basket of FIG. 1 is immersed in the tanks of FIG. 6.

Referring to FIGS. 4 and 12, a process for electrodespostion coating materials, such as components of cars, in the system with the foregoing construction will now be described.

Referring to FIG. 4, materials shot-peened in advance are loaded from the loading device into a basket B removed from the front conveyor F and placed on the foremost portion of the chain conveyor 14. The conveyor 14 is operated to move the basket B to the rearmost portion of the conveyor 14. Then, the basket is held or suspended by the front conveyor F (which is intermittently operated). To be more exact, the outer ends, or the generally V-shaped portions 8, of the opposed rods 5 of the basket are supported by opposed basket supports of the conveyor F. The conveyor F is operated to convey the basket into the second story of the building H. When the basket has reached a predetermined position in front of the first tank 16, the conveyor F is stopped for a certain period of time.

Referring to FIG. 12, before the basket reaches the foregoing position, the lower, carrier member of the basket carrier is already in such a position that the foremost pair of hooks 33 suspended from the carrier beams 32 of the carrier member are in positions 1. When the basket has reached the foregoing position, the motor $M_4$ is rotated in one direction to move the carrier member of the basket carrier, relative to the upper, support member thereof, in a forward direction until the foremost hooks 33 come to positions 2 [first step].

When the foremost hooks 33 has come to the positions 2, the motor $M_5$ is rotated in one direction to lift the entire basket carrier until the hooks 33 are raised to positions 3 (second step). When the hooks 33 are thus raised, they remove the basket from the conveyor F and carry the basket to the positions 3 by supporting, from below, the outer ends (generally V-shaped portion) 8 of the opposed rods 5 of the basket. [second step]

Then, the motor $M_4$ is rotated in the opposite direction to move the carrier member, relative the support member, until the hooks 33 come to positions 4 [third step].

Then, the motor $M_5$ is rotated in the opposite direction to lower the entire basket carrier until the hooks 33 are lowered to positions 5. When the hooks 33 are thus lowered, the basket is placed into the basket-swinging mechanism in the first tank 16. To be more exact, immediately before the hooks 33 reach the positions 5, the opposed arms 3 of the basket rest in the opposed recesses 25 of the frame 22 of the swinging mechanism and simultaneously with this the bottom of the basket is placed on the base 21 of the swinging mechanism. [fourth step]

Then, the motor $M_4$ is rotated in the foregoing opposite direction to move the carrier member until the hooks 33 come to positions 6 [fifth step].

Then, the motor $M_5$ is rotated in the foregoing one direction to lift the entire basket carrier until the hooks are raised to positions 7 [sixth step].

Then, the motor $M_4$ is rotated in the foregoing one direction to move the carrier member until the hooks come to positions 8 [seventh step].

Finally, the motor $M_5$ is rotated in the foregoing opposite direction to lower the entire basket carrier until the foremost hooks are lowered to the initial positions 1 [eighth step].

It will be appreciated that, when the foremost pair of hooks 33 do the foregoing first to eighth steps, all other pairs of hooks 33 also simultaneously do similar steps. For example, if a basket B is already in the first tank 16 (to be more exact, in the basket-swinging mechanism thereof) before the foremost pair hooks start to do the foregoing steps, the second pair of hooks carry that basket from the first tank 16 into the second tank 17 (to be more exact, into the basketswinging mechanism thereof) at the same time when the foremost hooks carry the basket conveyed to the position in front of the first tank, into the first tank 16. Also, with regard to the rearmost hooks, if a basket B has previously been placed in the last tank 20, the rearmost hooks place the basket on the table 31 at the same time when the foremost hooks do the foregoing fourth step.

Thus, each time the foregoing first to eighth steps (to be more exact, the first to fifth steps) are done, the basket in each tank is removed into the next tank or onto the table 31 while at the same time a new basket is placed into each tank.

After the baskets have been placed into the swinging mechanisms of the tanks, the motor $M_3$ is rotated in alternate directions to relatively slowly swing the swinging mechanisms and, hence, the baskets therein several times. The materials contained in the baskets are treated as previously mentioned while the baskets are being thus swung.

Referring to FIG. 4, the basket removed from the last tank onto the table 31 is suspended by the rear conveyor R. To be more exact, the outer ends (generally V-shaped portions) of the opposed rods 5 of the basket are supported, from below, by opposed basket supports 12 of the conveyor R. And the basket is conveyed by the conveyor R into the upper section, or the baking furnace Y, of the second story. And when the basket has reached a predetermined position relative to the in-furnace conveyor I, the basket is suspended by the conveyor I. To be more exact, the curved portions of the pieces 9 of the opposed rods 5 of the basket are supported in opposed support pieces 58 of the opposed chain members of the conveyor I. Then, the basket is conveyed through the furnace Y where the materials in the basket are baked.

When the basket has reached a predetermined position relative to the front conveyor F, the basket is suspended by the conveyor F, and is lowered thereby to the first story and placed into the case 73. When the basket has been placed into the case 73, the cylinders 91 are operated to cause the hooks 90 to firmly hold the opposed arms 3 of the basket into the recesses 89 of the case 73. Then, the motor $M_9$ is operated to overturn the case, thereby emptying the products (materials coated and baked) in the basket on the conveyor 92 through the chute 93. The products are conveyed by the conveyor 92. After emptying the products, the case 73 is returned to its upright position, and the hooks 90 are released from the arms 3 of the basket. Then, the motor $M_{10}$ is operated to lower the arms 71, to which is connected the case 73, to a position indicated by a broken line in FIG. 9, thereby lowering the case 73 to a position indicated by another broken line in FIG. 9. Then, the basket (which is now empty) in the case 73 is suspended by the front conveyor F again, and is conveyed thereby to the initial position on the conveyor 14.

Although the basket-swinging mechanisms in the tanks are swung by the chains 29 in the illustrated embodiment, the mechanisms may also be swung by links. Also, the mechanism for swinging the basket-swinging mechanisms which includes the chains 29, the motor $M_3$ and others may be entirely omitted if a mechanism for the same purpose is provided which includes a gear connected to each of the opposed pivots 23 for the swinging mechanism in each tank and another gear engaged with that gear and rotatable in either direction.

A relatively great number of motor parts of relatively small sizes may be loaded into the basket according to the invention. Also, since the basket is swung when the parts therein are coated in the tanks, the liquids in the tanks may reach every part on the surfaces of the parts and, thus, the parts may be uniformly coated, or may be covered with coatings with uniform thicknesses. Therefore, according to the invention, a relatively great number of motor parts of relatively small sizes may be coated at a time and, thus, the coating cost may be considerably reduced. Also, the system of the invention with these advantages may contribute towards automating the entire coating process and saving the energy required therefor.

What is claimed is:

1. A basket for containing materials to be electrodeposition coated, which comprises (a) a body including a frame and a wire netting connected to the frame to form side walls and a bottom of said body, said body having an open top, (b) a pair of first horizontal arms projecting outward from two opposed ones of said side walls of the body, respectively, (c) a pair of vertical members projecting upward from the tops of said two opposed ones of said side walls, respectively, and (d) a pair of second horizontal arms projecting outward from said vertical members, respectively.

2. A system for electrodeposition coating materials which comprises (A) baskets for containing materials to be electrodeposition coated, (B) a plurality of tanks arranged in a required order for electrodeposition coating the materials contained in the baskets, (C) a furnace for baking- the materials in the baskets which have been coated in said tanks, (D) a means provided in each said tank for supporting and swinging each said basket, (E) a means located above said tanks for placing each said basket into one of the tanks and removing each said basket from said one of the tanks into the next tank or onto a table provided next to the last tank, (F) said means (E) being vertically movable and comprising a pair of parallel upper and lower horizontal members, and (G) said lower member being connected to said upper member for horizontal movements relative to said upper member.

3. A system in accordance with claim 2 wherein (a) said upper and lower members of said means (E) each include a pair of opposed parallel horizontal beams connected to each other by transverse members, (b) each said beam of the lower member is parallel to and is suspended from one of said beams of the upper member by rollers movably connected to said one of said beams of the upper member, (c) a plurality of hooks are suspended, at equal intervals, from each said beam of the lower member, (d) each said hook suspended from each said beam of the lower member is opposed to one of said hooks suspended from the other beam of the lower member, thus making a pair therewith for suspending a basket, (e) said upper member is provided with a means for moving said lower member relative to said upper member, (f) said means for moving said lower member is connected to said lower member by chains, (g) a pair of horizontal bars extend above and along said beams of said upper member, respectively, said bars being movable in the directions of their lengths, (h) each said beam of said upper member is suspended from the associated bar extending thereabove by chains which each have one end connected to the beam, a portion fitted on a sprocket and another end connected to the bar, (i) said beams of said upper member and, hence, the whole of said means (E) are vertically moved when said bars are moved, (j) a chain is connected to one end of each said bar at one end thereof, and (k) said chain (j) is fitted on a sprocket at one portion thereof and has a balance weight at another end thereof, said balance weight being common to the chains (j) connected to the respective bars.

4. A process for the electrodeposition coating of materials which includes the steps of (A) loading materials to be electrodeposition coated into a basket, (B) introducing said basket into a plurality of tanks arranged in a selected order and containing the liquids required for the electrodeposition coating of the materials, thereby immersing the materials in the liquids, and (C) swinging the basket and the materials contained therein after introducing the basket into each said tank, (D) said basket comprising (i) a box-shaped body including a frame and a wire netting of expanded metal connected to the frame to form side walls and a bottom for said body, said body having an open top, (ii) a first pair of horizontal arms projecting outwardly from two of the opposed side walls of said body, (iii) a pair of vertical members projecting upwardly from the tops of said two opposed side walls of said body, and (iv) a second pair of horizontal arms projecting outwardly from the upper portions of said pair of vertical members.

5. A process in accordance with claim 4 which further includes placing said basket in a basket-swinging mechanism provided in each tank and then swinging said basket-swinging mechanism.

6. A system for the electrodeposition of coating materials which comprises (A) a plurality of baskets for containing materials to be electrodeposition coated, each basket comprising (i) a box-shaped body including a frame and a wire netting of expanded metal connected to the frame to form side walls and a bottom for said body, said body having an open top, (ii) a pair of horizontal arms projecting outwardly from two of the opposed side walls of said body, (iii) a pair of vertical members projecting upwardly from the tops of said two opposed side walls, and (iv) a pair of horizontal arms projecting outwardly from the upper portions of said pair of vertical members, (B) a plurality of tanks arranged in a selected order for the electrodeposition coating of the materials contained in said baskets, (C) a furnace for baking the materials in the baskets after the materials have been coated in said tanks, and (D) a means associated with each said tank for supporting and swinging each of said baskets.

7. A system in accordance with claim 6 wherein said means for supporting and swinging each of said baskets comprises a pair of recesses for receiving said first pair of horizontal arms.

* * * * *